United States Patent [19]

Shelffo

[11] 4,232,628

[45] Nov. 11, 1980

[54] TONER APPLICATOR FOR ELECTROSTATIC COPIER

[75] Inventor: Loren E. Shelffo, South Orange, N.J.

[73] Assignee: Eskofot Research A/S, Copenhagen, Denmark

[21] Appl. No.: 740,662

[22] Filed: Nov. 10, 1976

Related U.S. Application Data

[63] Continuation of Ser. No. 595,896, Jul. 15, 1975, abandoned.

[51] Int. Cl.[3] ..... G03G 15/08

[52] U.S. Cl. ..... 118/653

[58] Field of Search ..... 118/261, 259, 258, 661, 118/651, 653, 210

[56] References Cited

U.S. PATENT DOCUMENTS

| | | | |
|---|---|---|---|
| 504,718 | 9/1893 | Franke | 118/262 |
| 2,620,767 | 12/1952 | Lehman | 118/13 X |
| 2,787,244 | 4/1957 | Hickin | 118/259 |
| 3,198,648 | 8/1965 | Trimbur | 118/653 X |
| 3,340,849 | 9/1967 | Adams et al. | 118/261 X |
| 3,566,786 | 3/1971 | Kaufer et al. | 118/653 |
| 3,621,816 | 11/1971 | Donalies | 118/653 X |
| 3,762,365 | 10/1973 | Herzog | 118/261 |

FOREIGN PATENT DOCUMENTS

| | | | |
|---|---|---|---|
| 675069 | 4/1939 | Fed. Rep. of Germany | 118/261 |

*Primary Examiner*—Ronald Feldbaum
*Attorney, Agent, or Firm*—Michael Ebert

[57] ABSTRACT

An applicator for depositing toner particles onto an electrostatically-charged latent image formed on a photoconductive insulating layer to render visible and develop this image. The applicator includes a trough containing a supply of toner and provided with a flexible blade of dielectric material which engages the surface of a rotating carrier roll to form a tight nip. As the roll turns, toner particles at the bottom of the trough are advanced toward the blade and forced through the nip, the blade being deflected to admit a thin layer of particles which adhere to the roller surface. In the course of such passage, the particles are frictionally rubbed by the edge of the blade and thereby caused to assume a triboelectric charge. A paper web or other medium carrying an electrostatically-charged latent image of the intelligence to be copied is transported so as to engage the toner layer carried on the surface of the roll, whereby charged toner particles are transferred to the medium and deposited on the latent image to produce a developed image for subsequent fixing.

5 Claims, 3 Drawing Figures

ALTERNATIVE BLADE POSITIONS

TONER APPLICATOR FOR ELECTROSTATIC COPIER

RELATED APPLICATION

This application is a continuation of my copending application Ser. No. 595,896, filed July 15, 1975, now abandoned, of the same title.

BACKGROUND OF INVENTION

This invention relates generally to xerographic copiers, and more particularly to an improved applicator for depositing triboelectrically-charged toner particles onto an electrostatically-charged latent image to render visible and develop this image.

In the xerographic technique, a photoconductive insulating layer whose surface is uniformly charged electrically is first exposed to an illuminated pattern of light and shadow of the intelligence to be recorded. The blanket charge on the layer is selectively dissipated by the illuminated pattern to yield a latent electrostatic image. Thereafter, to develop the image, finely-divided pigmented thermoplastic powder or toner is deposited on the latent image, the toner particles adhering to the electrostatically-charged areas in proportion to the charges thereon.

In a plain paper xerographic printer such as that disclosed in the Boulton U.S. Pat. No. 2,987,037, the photoconductive insulating layer is supported on a rotating drum and the toner image developed on the surface of this layer is transferred from the drum onto a sheet of ordinary paper. The developed image on the paper is then fixed thereto by heat which fuses the toner particles to the paper. It is also known to effect such fusion by the application of pressure rather than heat.

In a treated-paper xerographic printer such as that disclosed in the Shelffo U.S. Pat. No. 3,520,604, there is no need to transfer the developed toner image from the photoconductive insulating layer, for in this instance use is made of paper coated with photoconductive zinc oxide particles dispersed in a film-forming resin binder. The coated surface of the paper is subjected to a blanket electrostatic charge which is then exposed to the light pattern to be recorded to create a latent image thereon. This latent image is developed by toner which is directly fixed onto the treated paper, thereby obviating the transfer step characteristic of an untreated paper printer.

The present invention is concerned primarily with apparatus adapted to deposit toner onto an electrostatically-charged latent image formed on a photoconductive layer, the invention being fully applicable both to treated and plain paper xerographic printers.

Among the known types of toner development systems are cascade, brush and magnetic brush development as well as powder cloud and liquid development. A cascade development system, such as that disclosed in the Shaffert U.S. Pat. No. 2,576,047, is adequate for making ordinary line copies, but it has limited value where solid area development is required. For solid area development producing a good copy of an original which includes photographs as well as printed text, brush applicators have greater utility.

In a brush development system such as the one described in Boulton U.S. Pat. No. 2,987,037, use is made of a soft fur brush which acts not only to pick up and transfer toner particles onto a latent electrostatic image, but also to impart a triboelectric charge to particles actually brought into contact with the brush hairs.

Currently, a widely used type of toner applicator in commercially-available xerographic printers is the magnetic brush system, such as that disclosed in the Morse U.S. Pat. No. 3,674,532. A magnetic brush developer requires a developer mix constituted by ferromagnetic iron particles intermingled with toner powder. This mix is picked up by a magnet having a bristle-like or brush formation, the iron particles being magnetically attracted to the bristles and the toner particles adhering electrostatically to the iron particles. The bristles are electrically conductive and contribute to the transfer of toner to the electrostatically-charged latent image.

A xerographic printer including a magnetic brush development system involves relatively costly and complex apparatus and is subject with prolonged use to contamination and other problems. Moreover, the iron particles are physically worked in the course of operation and the properties thereof are degraded, making it necessary from time to time to shut down the machine to replace the iron particles in the mix.

In order to overcome the drawbacks of existing magnetic brush development systems, it is known to provide toner particles having a ferromagnetic core covered with a thermoplastic resin sheath, thereby avoiding the need for a mix. But such two-component particles are expensive and add substantially to the cost of making copies.

SUMMARY OF INVENTION

In view of the foregoing, it is the main object of this invention to provide an improved applicator adapted to impart a triboelectric charge to toner particles and to form a thin, uniform layer thereof which is applied to a latent electrostatic image, thereby to develop this image.

An applicator in accordance with the invention is useful in conjunction with a plain paper xerographic printer wherein toner particles are applied to a photoconductive insulating layer formed on a transfer drum, or with a treated paper printer in which the particles are applied to the treated surface of the paper. The applicator is suitable for both line and solid area development.

More particularly, it is an object of this invention to provide an applicator in which a thin layer of triboelectrically-charged toner particles is formed uniformly on the surface of a rotating carrier roll which engages the surface of an advancing web of treated paper having a latent image thereon, the relative motion of the roll and the web being such as to create shear forces regulating and enhancing the deposition of toner particles on the latent image.

Among the significant advantages of a toner applicator in accordance with the invention for the developer stage of a xerographic printer are that the applicator is usable with low-cost, single component toner having no inherent magnetic properties, and that nothing need be added to the toner at any time. Moreover, the applicator does not entail the use of a magnetic or electrostatic carrier.

Yet another object of the invention is to provide an applicator of simple and inexpensive design which functions efficiently and reliably, and which requires little maintenance even after prolonged operation.

Briefly stated, these objects are attained in an applicator in which a supply of toner power is contained within a trough defined by a first plate having a flexible flap extending therefrom to engage the surface of the roll at one point thereon, thereby forming one inclined wall of the trough, and a second plate having a resilient blade of dielectric material extending therefrom and biased against the surface of the roll at another point thereon to form another inclined wall, the junction of the blade edge and the roll surface constituting a tight nip. As the roll turns, toner particles at the bottom of the trough are advanced toward the blade and forced through the nip, the blade flexing to admit a thin layer of the particles which adhere to the roll surface.

In the course of such passage, the particles passing through the tight nip are frictionally rubbed by the edge of the blade and thereby caused to assume an electrostatic charge whose polarity depends on the triboelectric nature of the toner.

The paper or other medium having an electrostatically-charged latent image thereon is transported so as to engage the toner layer carried by the roll in a path wherein the electrostatically-charged toner particles are attracted to and transferred to the medium and deposited on the charged latent image to develop the image. The applicator roll is preferably rotated at a rate producing a surface speed relative to the speed of the advancing medium so as to create shear forces therebetween acting to regulate the deposition of the charged toner particles.

OUTLINE OF THE DRAWINGS

For a better understanding of the invention as well as other objects and further features thereof, reference is made to the following detailed description to be read in conjunction with the accompanying drawings, wherein:

FIG. 1 schematically shows in perspective an applicator in accordance with the invention;

DESCRIPTION OF INVENTION

Figure 1:
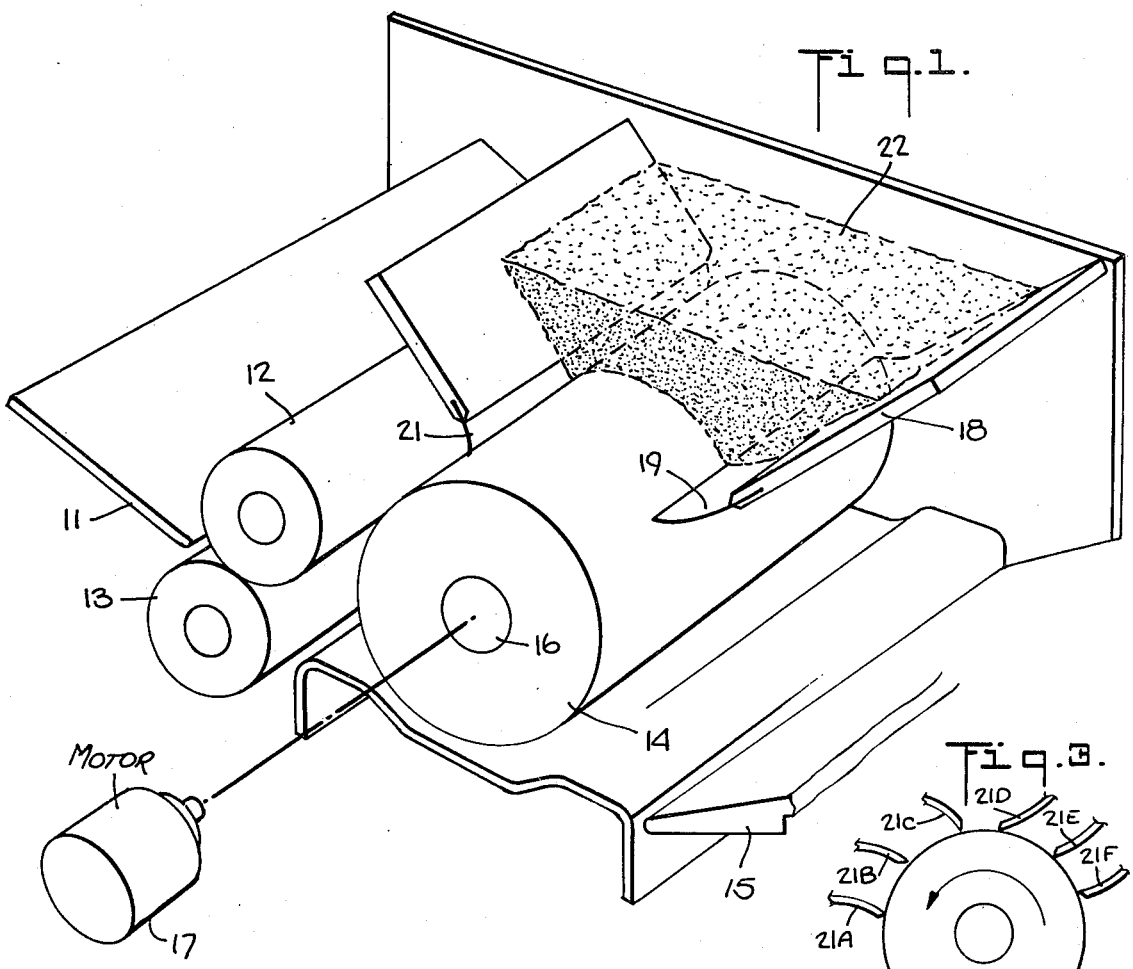

Referring now to the drawing, there is shown an applicator in accordance with the invention adapted to operate in the development stage of a treated paper xerographic printer in which copies of documents are made directly on a web 10 of treated paper. The photoelectrostatic technique for making copies of a graphic original on a treated or coated paper is more specifically described in an article entitled "Electrofax Direct Electrophotographic Printing on Paper" by C. J. Young et al. in the RCA Review, Vol. 15, No. 4, pp. 469–484, December 1954.

In the basic "Electrofax" process described in this article, a blanket electrostatic charge is imposed on the coated side of web 10 in a dark chamber. The charged surface is thereafter exposed to a pattern of light and shadow of the original to be recorded in order to form a latent electrostatic image thereof on the photoconductive surface of this paper.

In the applicator, the latent image is formed on the upper face 10A of paper web 10, the web entering the applicator along an input guide 11 and being drawn therein by a pair of cooperating rollers 12 and 13. The advancing web is then conveyed across a double-humped pressure shoe PS which is adapted to press the portion of the web bridged across the humps against the underside of a rotating applicator roll 14.

From the shoe, web 14 travels across an output paper guide 15 from which it passes into the fixing stage of the xerographic printer. The nature of the fixing stage forms no part of the present invention. However, it is to be noted that the applicator makes use of toner particles which lend themselves to fusion by pressure, making it possible to provide a simple, compact and efficient low-cost xerographic printer requiring no warm-up period as in the case of printers which make use of a thermal fixing stage.

Roll 14 is supported on a shaft 16 operatively coupled by suitable gears or belts to a variable-speed motor 17, whereby the rotary speed of the roll relative to the speed of the advancing web may be adjusted to bring about optimum transfer conditions.

Associated with roll 14 is an inclined plate 18 extending the full length of the roll and having a flexible sealing flap 19 extending downwardly from the under side of the plate. Flap 19 engages the upper surface of roll 14 at a position disposed to the right of the vertical plane Y passing through the axis X of the roll. Also associated with the roll is an oppositely-inclined plate 20 which extends the full length of the roll, plate 20 having a blade 21 extending downwardly from the lower side thereof.

Blade 21 functions to impart an electrostatic charge to the toner particles and must therefore be fabricated of high strength, flexible material having good dielectric properties. Suitable for this purpose are Mylar, polyethylene, polycarbonate and other plastic dielectric materials having acceptable mechanical and dielectric properties.

Figure 2:
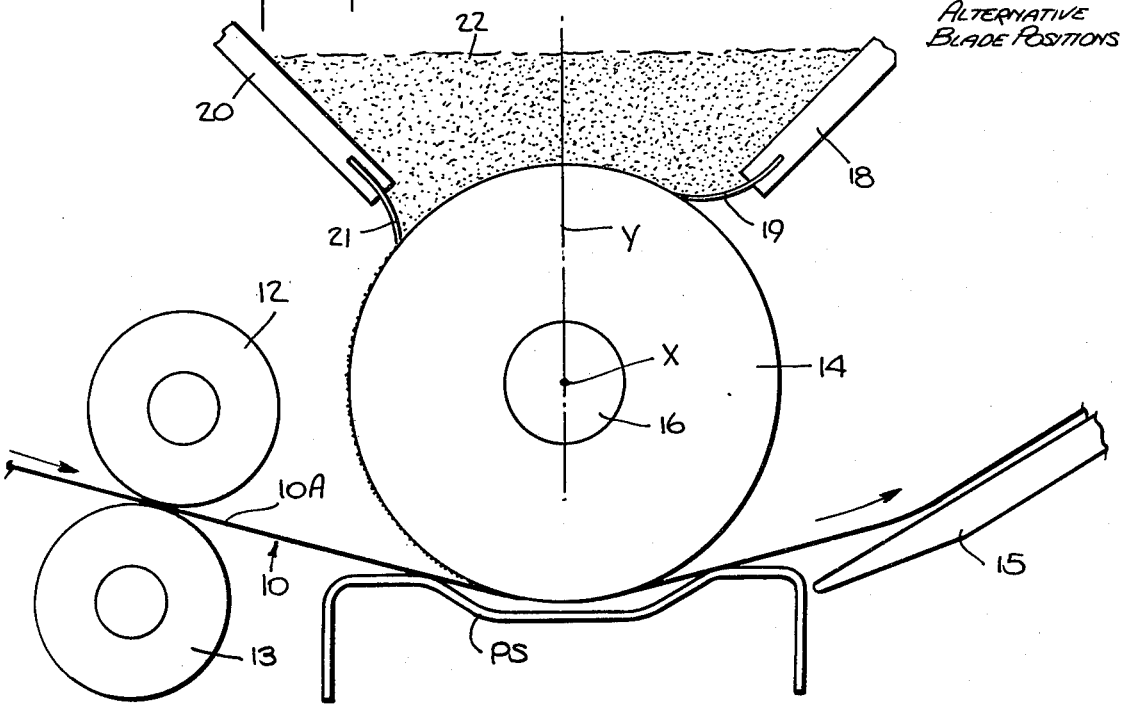
FIG. 2 is an end view of the applicator.

As shown in FIG. 2, the plate arrangement is such as to bias blade 21 so that its edge presses against the upper surface of the roll to form a tight nip at the junction of the edge and roll surface at a point displaced to the left of the vertical plane Y. Roll 14 turns in the counter-clockwise direction, and because blade 21 is biased, the blade is somewhat deflected, with its edge pressed tangentially against the moving surface of the roll.

The inclined plates in combination with the rolls and end plates (not shown) define a trough for retaining a substantial supply 22 of toner particles therein. These particles are formed of pigmented, low-cost thermoplastic powder such as polyamide resin or polystyrene. The particle sizes may be in a range of about 15 to 35 microns, but preferably they lie in a narrow range of about 20 to 30 microns.

The toner particles in the supply thereof which are at the bottom of the trough and lie against the surface of the rotating roll are advanced thereby toward blade 21 and forced through the tight nip. Because of the pressure exerted by the blade edge against the roll surface, only a thin layer of particles is admitted through the nip.

As the particles are forced through this tight nip, they rub frictionally against the dielectric edge of the blade and thereby acquire a triboelectric charge whose polarity depends on the nature of the particles. The polarity of the charge to be imparted to the toner depends on the requirements of the xerographic printer and on whether one wishes to develop a negative or positive image.

The choice of dielectric materials for the charge-inducing blade and for the toner which rubs against the edge of the blade is governed by the principles of frictional electricity or tribo-electrification, which relate to the phenomenon occurring when two dissimilar substances are rubbed together. In general, it can be said that the potential difference between two contacting dielectrics is proportional to the difference between their dielectric constants, the one having the greater constant being rendered positive. Materials are often listed in a triboelectric series wherein any material on the list, when rubbed against another material occupying a lower position on the list, becomes positive.

The reason why it is important that the toner particles lie within a narrow size range is to insure frictional engagement between virtually all of the particles in the layer and the blade edge. Should the particles lie within a large range, then only the larger sizes thereof would rub against the edge and assume a charge, whereas the finer particles would be neglected and lack proper attractive properties. But by providing particles all within a narrow range, substantially all of the particles are triboelectrically-charged.

In order to provide an electric field between roll 14 and the latent electrostatic image formed on the upper face 10A on web 10, roll 14 is preferably formed of an electrically-conductive elastomeric material suitable as a carrier for the toner such as rubber or Neoprene, having graphite or other conductive material dispersed therein.

Roll 14 is mounted on electrically-insulated bearings so that a bias potential may be applied between the roll and output paper guide 15. The applied bias voltage lies in a range of from about 10 to 250 volts d.c., with a sign appropriate to the type of toner used and the type of print desired. Alternatively, a suitable Zener diode can be connected between the roll and the guide plate to limit the induced bias to an appropriate level.

The function of bias in the present system is the same as that in two-component magnetic brush developing; namely, the reduction or elimination of toner deposition in the non-image areas of the photoconductive surface. In positive printing wherein toner is deposited on the charged areas of a photoconductive surface, the bias used would have the same sign as the photoconductive charge and would act to hold toner to the roll. Thus if the charge on the image areas of the photoconductive surface were 300 volts negative and the charge on the non-image areas were 50 volts, then a bias of 100 volts negative on the roll would act to prevent toner deposition in the non-image areas.

In reversal printing, wherein toner is deposited on the discharged areas of the photoconductive surface, the bias prevents background toning by maintaining a voltage on the toner which acts to reduce or eliminate deposition in the areas of like sign on the photoconductive surface.

Thus coated on the surface of roll 14 as it departs from the edge of blade 21 is a thin uniform layer of charged toner particles. This toner layer carried by the roll engages the latent electrostatic image on the upper surface of web 10 and is selectively transferred thereto, the particles being attracted only to charged areas on the web. The remaining particles in the layer are not wasted but return through the sealing flap 19 to the trough region for recycling.

In practice, it has been found desirable to run roll 14 at a high speed, producing relative motion between the surface of the roll and the paper web engaged thereby. The resultant shear or sliding forces therebetween act to regulate and enhance the deposition of the charged toner particles on the latent image and improves the developed image.

Blades which perform effectively are fabricated from any one of the following dielectric materials: Teflon, Mylar, H-Film (DuPont Polyamide), polycarbonate and cellulose acetate in thickness of about 5 mils to 1/16 of an inch. The blade edge must be straight and smooth to permit uniform contact with the toner along the entire length of the nip. Nicks or scratches in the blade edge as minute as 0.002 inches can cause print defects. In practice, the edge can be bevelled in either direction and possibly rounded.

Figure 3:
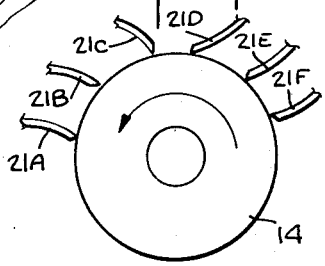
FIG. 3 shows a detail of the applicator.

The contact angle assumed by the blade relative to the roll at the nip is not critical. Any one of the various possible configurations represented by blades 21A, 21B, 21C, 21D, 21E and 21F in FIG. 3 will function acceptably. However, the critical aspect of the system lies in the nip pressure. Insufficient pressure will permit toner to pass through the nip without proper rubbing contact with the blade. With inadequate rubbing contact, the layer of toner on roll 14 will not be uniformly charged, and will give rise to weak and/or high background prints. On the other hand, excessive nip pressure will reduce the thickness of the toner layer, thereby producing weak, low-density prints. In practice, therefore, the system is provided with blade adjusting means (not shown), making it possible to set the nip pressure to an optimum value.

While there has been shown and described a preferred embodiment of a toner applicator for an electrostatic copier in accordance with the invention, it will be appreciated that many changes and modifications may be made therein without, however, departing from the essential spirit thereof.

I claim:

1. An applicator adapted to deposit triboelectrically-charged toner particles on an electrostatically charged latent image formed on a photo-conductive insulating moving medium in a xerographic system, said applicator comprising:

A. a rotatable roll formed of conductive elastomeric material and mounted on electrically-insulated bearings so that a bias may be applied thereto;

B. a trough for retaining a supply of non-magnetic toner particles, said trough being defined by two spaced plates associated with the surface of the roll, one plate having a deflectable blade extending therefrom formed of dielectric material, the edge of the blade being pressed tangentically against the moving roll surface and being somewhat deflected thereby against the roll surface to form a tight nip therewith which only admits a thin layer of said particles drawn from the bottom of the trough, the particles admitted through said nip rubbing against said edge and being triboelectrically charged thereby, whereby the layer carried on the roll surface departing from the nip is constituted by charged toner particles which adhere to the roll, said toner particles having sizes lying within a relatively narrow range to insure frictional engagement between substantially all of the particles in the thin layer thereof and said blade edge;

C. means bringing about engagement between the charged layer of toner particles on the roll surface and said moving medium at a position displaced from the nip to effect a transfer of particles to said latent image on said medium to produce a developed image thereon;

D. means to rotate said roll at a speed producing relative motion between the surface thereof and the medium to develop shear forces therebetween to enhance the deposition of charged toner particles on the latent image to produce an improved developed image.

2. An applicator as set forth in claim 1, wherein the other plate includes a flexible sealing flap engaging the surface of the roll.

3. An applicator as set forth in claim 1, wherein said medium is a paper web coated with a photoconductive insulating layer which is brought into engagement with the charged toner particles on the roll surface.

4. An applicator as set forth in claim 3, further including a shoe pressing a portion of said web against the roll surface.

5. An applicator as set forth in claim 3, further including means to advance said web.

* * * * *